US010823109B2

(12) United States Patent
Lormes

(10) Patent No.: US 10,823,109 B2
(45) Date of Patent: Nov. 3, 2020

(54) PISTON FOR AN INTERNAL COMBUSTION ENGINE

(71) Applicant: KS Kolbenschmidt GmbH, Neckarsulm (DE)

(72) Inventor: Klaus Lormes, Bad Wimpfen (DE)

(73) Assignee: KS Kolbenschmidt GmbH, Neckarsulm (DE)

( * ) Notice: Subject to any disclaimer, the term of this patent is extended or adjusted under 35 U.S.C. 154(b) by 106 days.

(21) Appl. No.: 15/751,227

(22) PCT Filed: Aug. 11, 2016

(86) PCT No.: PCT/EP2016/069170
§ 371 (c)(1),
(2) Date: Jun. 4, 2018

(87) PCT Pub. No.: WO2017/025608
PCT Pub. Date: Feb. 16, 2017

(65) Prior Publication Data

US 2018/0306139 A1 Oct. 25, 2018

(30) Foreign Application Priority Data

Aug. 11, 2015 (DE) ..... 10 2015 215 313

(51) Int. Cl.
*F02F 3/02* (2006.01)
*F02F 3/00* (2006.01)
*F02F 3/26* (2006.01)

(52) U.S. Cl.
CPC ..... *F02F 3/02* (2013.01); *F02F 3/26* (2013.01); *F02F 2003/0007* (2013.01)

(58) Field of Classification Search
CPC ..... F02F 3/022
See application file for complete search history.

(56) References Cited

U.S. PATENT DOCUMENTS 6,659,063 B2 * 12/2003 Nomura ..... F02F 3/00 123/193.6
2010/0147251 A1 6/2010 Blau et al.
2013/0233270 A1 9/2013 Brandt et al.

FOREIGN PATENT DOCUMENTS

| | | | |
|---|---|---|---|
| CN | 204327307 | U | 5/2015 |
| CN | 204851463 | U | 12/2015 |
| DE | 1974065 | U | 12/1967 |
| DE | 10145589 | A1 | 4/2003 |
| DE | 102005041002 | A1 | 3/2007 |
| DE | 102011080822 | A1 | 2/2013 |
| DE | 102011085448 | A1 | 5/2013 |

(Continued)

*Primary Examiner* — Abiy Teka
*Assistant Examiner* — Michael Quandt
(74) *Attorney, Agent, or Firm* — Young Basile Hanlon & MacFarlane, P.C.

(57) ABSTRACT

A piston for use in an internal combustion engine having a pressure side and counterpressure side. The piston includes a piston skirt having skirt wall sections and box walls connecting the skirt wall sections. A spacing between the box walls on the pressure side is 35%-51% of the piston diameter and on the counterpressure side is 26%-39% of the piston diameter. Reduced angles of the extraction angle slopes on the pressure and counterpressure sides as well as larger free spaces are achieved which provides for lower piston mass and greater distribution of stresses in the box region of the piston.

17 Claims, 13 Drawing Sheets

(56) References Cited

FOREIGN PATENT DOCUMENTS

| | | | |
|---|---|---|---|
| DE | 102014114785 | A1 | 4/2015 |
| EP | 2029318 | A1 | 3/2009 |
| JP | H0299245 | U | 8/1990 |
| JP | 2002317691 | A | 10/2002 |

* cited by examiner

PISTON FOR AN INTERNAL COMBUSTION ENGINE

CROSS-REFERENCE TO RELATED APPLICATIONS

This application is filed pursuant to 35 USC 371 claiming priority benefit to PCT/EP2016/069170 filed Aug. 11, 2016 and German patent application 102015215313.4 filed Aug. 11, 2015, the entire contents of both applications herein incorporated by reference in their entirety.

TECHNICAL FIELD

The invention relates to a piston for an internal combustion engine.

BACKGROUND

A piston for internal combustion engines is known from DE 197 40 065 A1 which forms the generic type. In the case of this piston, the hubs are set back in the bolt axial direction in such a manner that the outer hub spacing is 60% to 65% of the piston diameter or less. The hub outer surfaces which connect the two sliding surfaces to each other have a rectilinear (linear) profile, as viewed over the height of the sliding surfaces. In the case of this piston, the hub outer surfaces (also called box walls) are basically not flat, but rather curved, specifically both in sections parallel to and also perpendicularly to the piston axis. However, the direction of curvature of the surface in sections perpendicular to the piston axis is always constant for the entire surface of the box wall. As the spacing between the box walls becomes smaller upwardly (in the direction of the piston head), this results in an upwardly decreasing width of the supporting sliding surface.

DE 197 40 065 A1 therefore discloses a light metal piston for internal combustion engines comprising a roof-shaped piston head with a combustion space depression, wherein the hubs are set back in the bolt axial direction in such a manner that the outer hub spacing is 60% to 65% of the piston diameter or less, and wherein an open cavity enclosing an angle of between 45° and 60° in the circumferential direction is provided above the outer surfaces of the set-back hubs, said cavity extending in the direction of the piston head into the region behind the ring field, and wherein the hub inner surfaces are formed trapezoidally or recessed in a stepped manner, and the skirt length is 40% to 45% of the piston diameter.

Furthermore, a piston is known from DE 101 45 589 A1. Said piston has a piston head which consists of a ring field with a plurality of annular grooves and optionally a combustion space depression. In the direction of movement of the piston, a piston skirt is arranged under the piston head, wherein said piston skirt consists of two skirt wall sections which support the piston during operation in the internal combustion engine and which serve to guide the piston in the cylinder of the internal combustion engine. The skirt wall sections are connected to one another via set-back connecting walls, wherein the connecting walls do not have a connection to the running surface of the cylinder.

In the piston in said DE 101 45 589 A1, the connecting walls have a curved profile which may be convex, concave or a combination of said curves. Furthermore, in the region of the connecting walls in this known piston the lower edge of the ring field is formed so as to protrude beyond said connecting walls (projecting length) and is at least partially hollowed out there such that a free space is produced in order to save weight.

SUMMARY

The invention is based on the object of producing a piston for an internal combustion engine with a reduction in the piston mass and improved distribution of stresses in the box region of the piston.

According to the invention, it is provided that the piston has a spacing between the box walls of between 35% and 51% of the piston diameter on its pressure side, and/or that the piston has a spacing between the box walls of between 26% and 39% of the piston diameter on its counterpressure side.

Pressure side refers to that side of the piston or cylinder on which the piston is supported during the combustion. The pressure side is opposed to the direction of rotation of the crankshaft. The counterpressure side is that side of the piston or cylinder which lies opposite the pressure side. By means of the skirt support designed according to the invention, a more homogeneous distribution of stresses within the piston is achieved. Even larger ring field undercuts can therefore be made. The mass of the piston is significantly reduced, but at the same time withstands the demands of current internal combustion engines having extremely high thermal and mechanical loads.

Furthermore, it is provided according to the invention that the piston has a spacing between the box walls of between 40% and 51%, preferably between 46% and 49% of the piston diameter, on its pressure side. It is also provided according to the invention that the piston has a spacing between the box walls of between 30% and 39%, preferably between 34% and 37% of the piston diameter, on its counterpressure side. By this means, the box walls move closer to each other, as a result of which this leads to a further saving on material. Smaller skirt surfaces on the pressure side and counterpressure side of the piston lead to the reduction in the friction.

Furthermore, it is provided according to the invention that a spacing between an upper edge of a fire land and a vertex of a free space transversely with respect to a bolt bore axis of the piston is smaller than the extent of the fire land. Furthermore, it is provided according to the invention that the spacing between the upper edge of the fire land and the vertex of the free space parallel to the bolt bore axis is smaller than the extent of the fire land. The larger undercuts in the weight pockets of the ring field permit the use of optimized casting mold technology.

Furthermore, it is provided according to the invention that the spacing between the upper edge of the fire land and the vertex of the free space transversely with respect to the bolt bore axis of the piston and/or a spacing between the upper edge of the fire land and the vertex of the free space parallel to the bolt bore axis are/is between 50% and 95%, preferably between 65% and 90%, smaller the extent of the fire land. By this means, a saving on material and a reduction in the piston mass are achieved.

Furthermore, it is provided according to the invention that a radial depth of a lift-out groove has a size of greater than or equal to 2 millimeters (mm), preferably greater than or equal to 3 mm, in particular greater than or equal to 4 mm By means of as large a radial depth as possible of the lift-out groove, the piston mass is reduced in this region.

Furthermore, it is provided according to the invention that a spacing between a center line of the box wall on the pressure side and a center line of the piston transversely with respect to the bolt bore axis is greater than a distance between a center line of the box wall on the pressure side and the center line of the piston transversely with respect to the bolt bore axis on the circumference of the piston. By means of the box walls designed according to the invention, a reduction in the extraction slope for the casting mold inserts has been realized. This in turn permits an enlargement of the free spaces behind the ring field, which leads to a reduction in the piston mass.

Furthermore, it is provided according to the invention that a spacing between a center line of the box wall on the counterpressure side and the center line of the piston transversely with respect to the bolt bore axis is smaller than the spacing between the center line of the box wall on the pressure side and the center line of the piston transversely with respect to the bolt bore axis. By means of the box walls designed according to the invention, a reduction in the extraction slope for the casting mold inserts has been realized. This in turn permits an enlargement of the free spaces behind the ring field, which leads to a reduction in the piston mass.

Furthermore, it is provided according to the invention that a spacing between the center line of the box wall on the counterpressure side and the center line of the piston transversely with respect to the bolt bore axis on the circumference of the piston is smaller than the spacing between the center line of the box wall on the counterpressure side and the center line of the piston transversely with respect to the bolt bore axis. By means of the box walls designed according to the invention, a reduction in the extraction slope for the casting mold inserts has been realized. This in turn permits an enlargement of the free spaces behind the ring field, which leads to a reduction in the piston mass.

Furthermore, it is provided according to the invention the spacing between the center line of the box wall on the pressure side and the center line of the piston transversely with respect to the bolt bore axis and the center line of the box wall is 10% to 35%, preferably 15% to 30%, in particular 20% to 25% of the piston diameter. The curved hub in conjunction with the newly designed skirt connection makes it possible, by means of the resulting support of the head, to minimize stresses in the combustion space depression in the case of highly loaded direct injection internal combustion engines.

Hub end surfaces fully integrated in the box contour. In comparison to the prior art, a reduction in mass by approximately 15% because of the homogeneous box wall design is an improved distribution of stresses is obtained.

By means of the use of suitable piston alloys, in particular the applicant's piston alloy KS 309, and the consequent adaption of the piston design to the resulting material-specific advantages, the wall thickness of the piston head could be reduced by up to 30%. This achieves a reduction in the mass of the piston.

BRIEF DESCRIPTION OF THE DRAWINGS

The basic concept is explained below with reference to the figures. Further details of the invention are described below in the figures with reference to illustrated exemplary embodiments.

DETAILED DESCRIPTION

Figure 1:
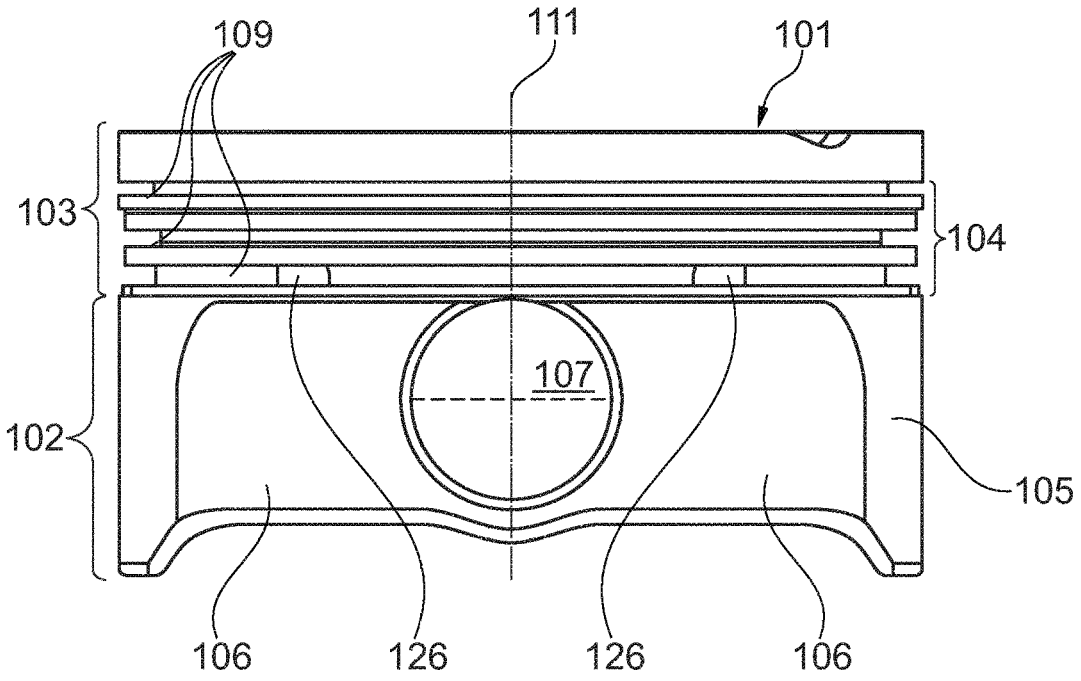
PRIOR ART Fig. 1
FIG. 1 shows a view of a piston according to the prior art DE 10 2005 041 002 A1.
Figure 2:
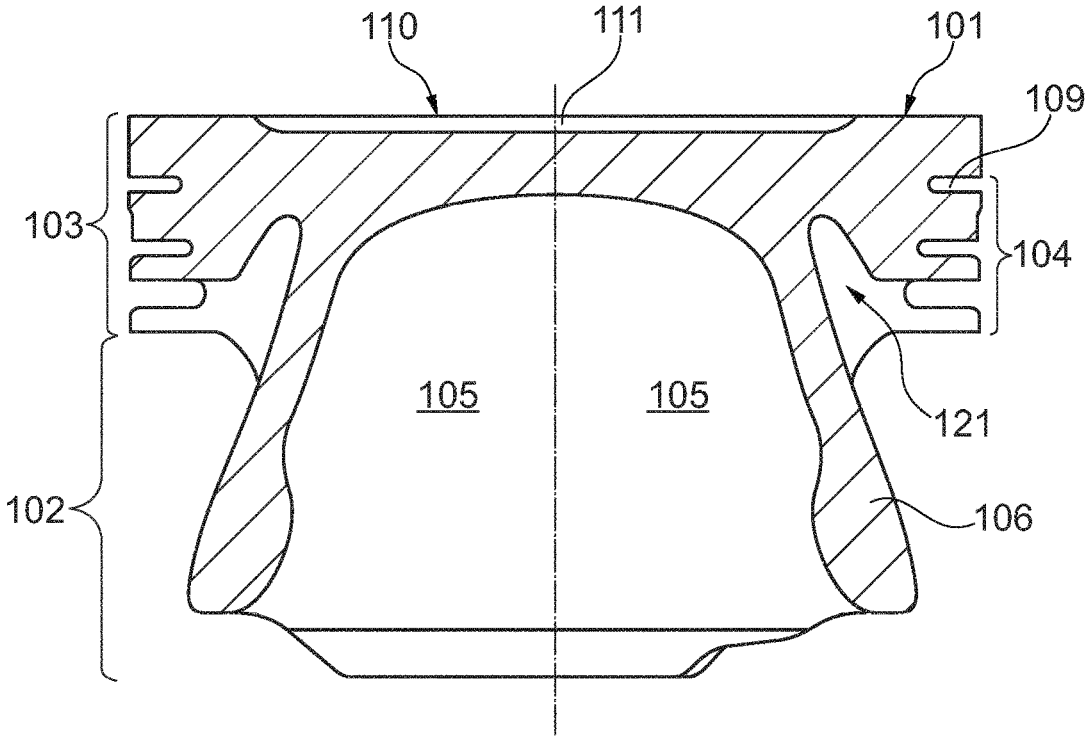
PRIOR ART Fig. 2
FIG. 2 shows a sectional view of a piston according to the prior art DE 10 2005 041 002 A1.

FIG. 1 shows a view of a piston 101 according to the prior art DE 10 2005 041 002 A1, and FIG. 2 shows a sectional view of the piston 101. A piston 101 of this type consists of a piston skirt 102 with an adjoining piston head 103, wherein piston skirt 102 and piston head 103 are formed integrally or consist of two parts which are joined together after their manufacturing. During the operation of the internal combustion engine, the piston 101 moves along a piston stroke axis 111 in a cylinder (not illustrated). Furthermore, the piston 101 has a ring field 104 with generally three annular grooves 109. The piston skirt 102 consists of skirt wall sections 105 supporting the piston 101, wherein the skirt wall sections 105 are connected to one another by set-back connecting walls 106. The connecting walls 106 have a curved profile, wherein different configurations can be provided with respect to the curved profile of the connecting walls 106. Furthermore, the set-back connecting walls 106 have a bolt bore 107 for receiving a bolt for connecting the piston 111 to a connecting rod (not illustrated). The piston head 103 has an optional combustion space depression 110. Furthermore, it is shown that there is a free space 121 in the region of the piston head 103 set back behind the ring field 104 and above the piston bore 107.

The illustration of FIG. 1 shows a drainage opening 126. The drainage opening 126 is arranged in the region of the annular groove 109, and therefore a connection of the annular groove 109 into the free space 121 arises when the annular groove 109 is introduced into the piston blank. The region of the drainage opening 126 behind the annular groove 109, i.e. in the region of the free space 121, can be of cup-shaped design. When in particular a three-part oil ring is used in the annular groove 109, oil can be removed from the surface of the piston 101 or from the cylinder running surface in the direction of the inner region of the piston 101 via the drainage opening 126. For this purpose, the drainage opening 126, in the case of which in particular one drainage opening is in each case arranged, in particular symmetrically, on the right and left of the bolt bore 107, are located in the region of the set-back connecting walls 106 since there is sufficient space here for the removed oil.

FIGS. 3 to 13 show various views of an exemplary embodiment of a piston 1 of an internal combustion engine, which piston can be configured as a lightweight piston but does not have to be. If the piston is a lightweight piston, a piston blank is firstly cast from a lightweight material, in particular aluminum or an aluminum alloy, and then finished by means of, for example, metal cutting processing. The basic design of such a piston 1 consists of a piston skirt 2 with an adjoining piston head 3, wherein piston skirt 2 and piston head 3 are formed integrally or consist of two parts which are joined together after their production. During the operation of the internal combustion engine, the piston 1 moves along a piston stroke axis 11 in a cylinder (not illustrated). Furthermore, the piston 1 has a ring field 4 with generally three annular grooves.

The piston skirt 2 consists of skirt wall sections 5 which support the piston 1, wherein the skirt wall sections 5 are connected to one another by means of set-back connecting walls 6. The connecting walls 6 have a curved profile, wherein different configurations can be provided with respect to the curved profile of the connecting walls 6. Reference is made to said curved profile (concave and/or convex from one skirt wall section to the other skirt wall section and/or in its profile in the piston stroke axis 11) since said profile is particularly important in terms of saving weight while simultaneously retaining the necessary strength. The set-back connecting walls 6 also have a bolt bore 7 for receiving a bolt for connecting the piston 1 to a connecting rod (not illustrated). A bolt bore axis 8 is depicted within the bolt bore 7. The piston head 3 has an optional combustion space depression 10. Furthermore, it is shown that there is a free space 21 in the region of the piston head 3, set back behind the ring field 4 and above the bolt bore 7.

Figure 3:
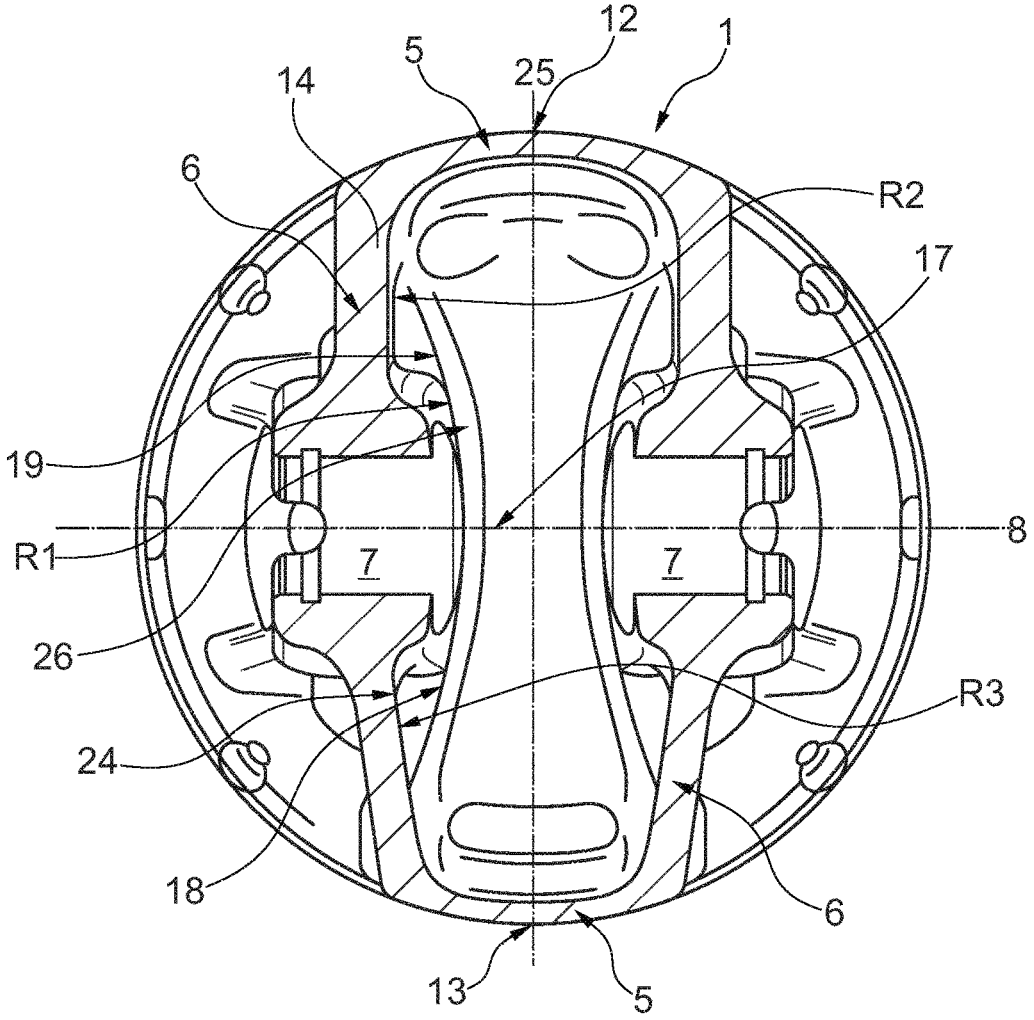
FIG. 3 shows a sectional view from below of a piston according to the invention.

FIG. 3 shows a sectional view from below of a piston according to the invention. A curve 24 of the box wall 14 at a lower apex 18 is opposed to a curve 26 of inner hub end surfaces 17 and of the box wall 14 in an upper apex 19. In FIG. 3, the pressure side 12 of the piston 1 is shown at the top and the counterpressure side 13 at the bottom. The profile and/or the extent of the curve 24 also has the advantage that a free space 21 is provided in the inner region of the piston, which is necessary for the play requirement of a trapezoidal connecting rod (not illustrated), via which the piston 1 is connectable to the crankshaft (likewise not illustrated).

R1 indicates the radius of the box wall 14 above the bolt bore 7. The radius of the box wall 14 on the pressure side 12 of the piston 1 is referred to by R2. R3 in turn stands for the radius of the box wall 14 on the counterpressure side 13 of the piston 1.

Figure 4:
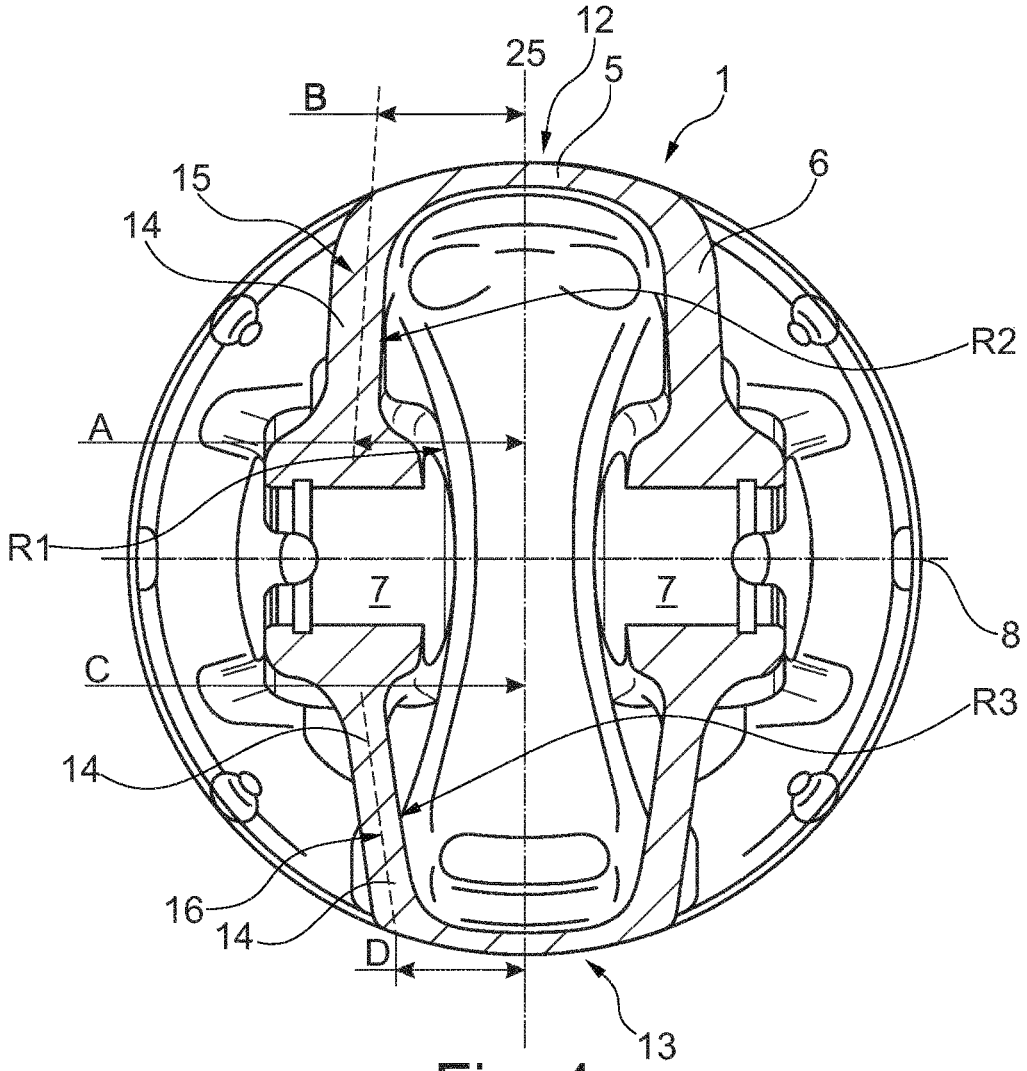
FIG. 4 shows a further sectional view from below of the piston according to FIG. 3.

FIG. 4 shows a further sectional view from below of the piston 1 according to FIG. 3. The position of the box wall 14 in the lower apex 18 is depicted. The center line 15 of the box wall 14 on the pressure side 12 of the piston 1 and the center line 16 of the box wall 14 on the counterpressure side 13 are marked.

Figure 5:
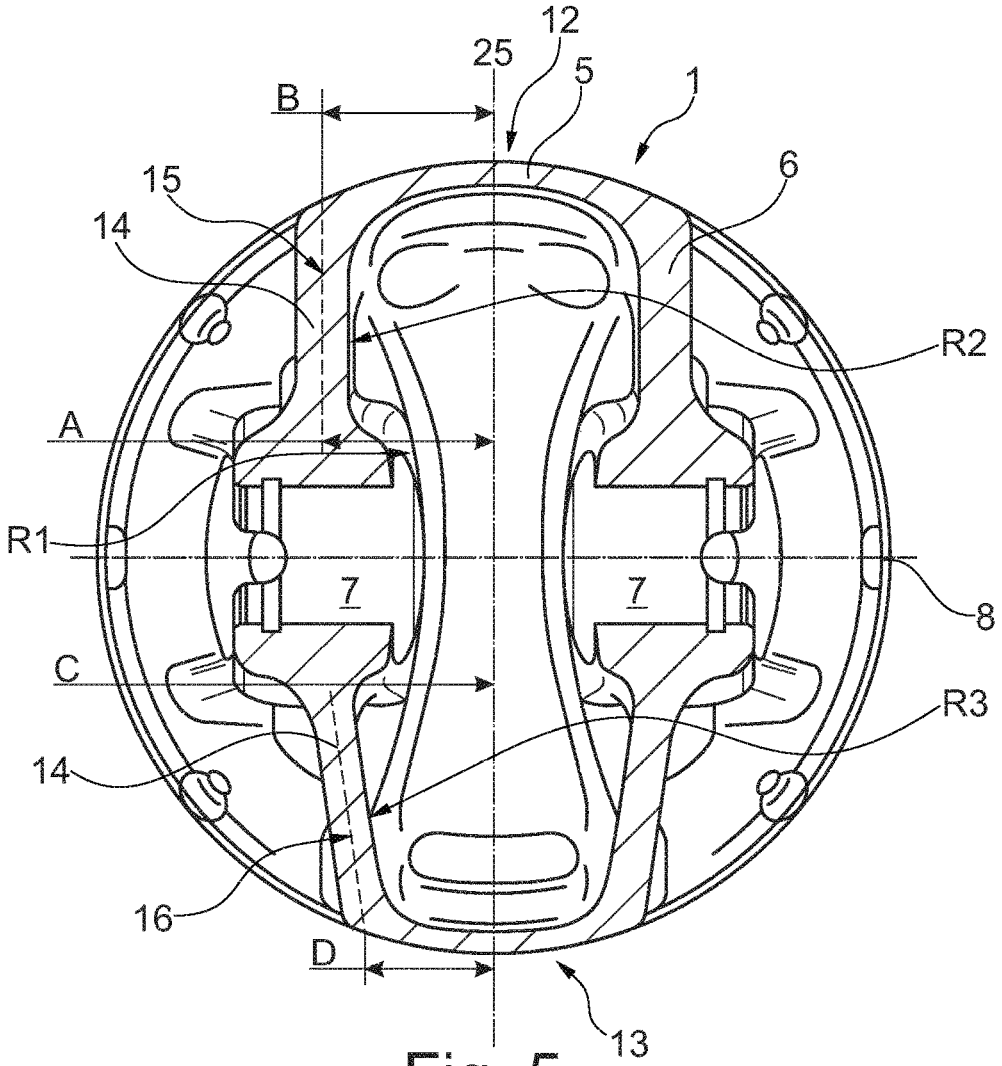
FIG. 5 shows a further sectional view from below of the piston according to FIG. 3.

FIG. 5 shows yet another sectional view from below of the piston 1 according to FIG. 3; the position of the box wall 14 in the lower apex 18 is illustrated here.

"A" denotes the spacing between the center line 15 of the box wall 14 on the pressure side 12 and the center line 25 of the piston 1 transversely with respect to the bolt bore axis 8. "B" indicates the spacing between the center line 15 of the box wall 14 on the pressure side 12 and the center line 25 of the piston 1 transversely with respect to the bolt bore axis 8 on the circumference of the piston 1. "C" stands for the spacing between the center line 16 of the box wall 14 on the counterpressure side 13 and the center line 25 of the piston transversely with respect to the bolt bore axis 8. "D" is the spacing between the center line 16 of the box wall 14 on the counterpressure side 13 and the center line 25 of the piston 1 transversely with respect to the bolt bore axis 8 on the circumference of the piston 1.

Spacing with the applicable conditions

Spacing A: 20% to 25% of the piston diameter 20

Spacing B: B<A

Spacing C: C<A

Spacing D: D<C

Figure 6:
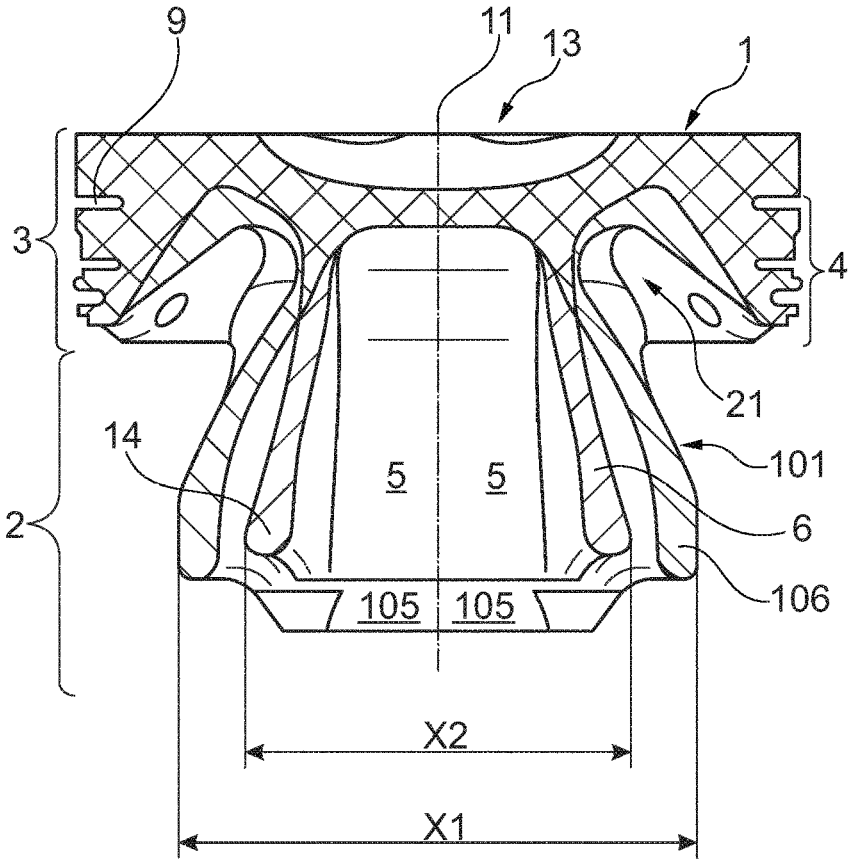
FIG. 6 shows a lateral sectional view (counterpressure side) of the piston according to FIG. 3 and, for comparison, the outline of a piston according to FIG. 2.
Figure 7:
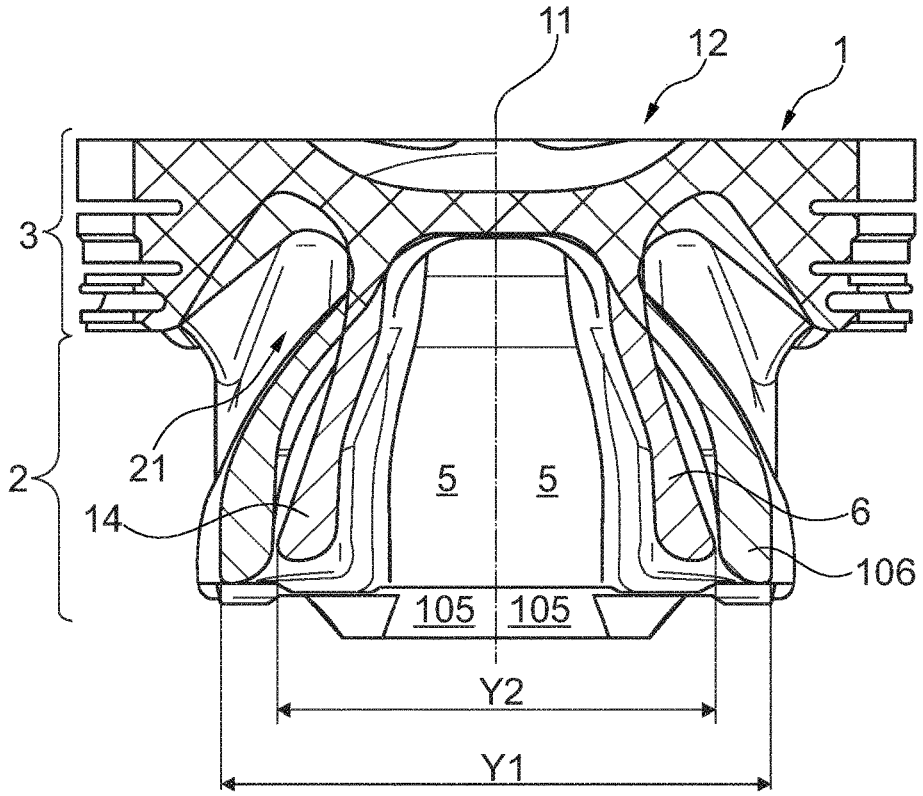
FIG. 7 shows a lateral sectional view (pressure side) of the piston according to FIG. 3 and, for comparison, the outline of a piston according to FIG. 2.

FIG. 6 shows a lateral sectional view (counterpressure side 13) of the piston 1 according to FIG. 3 and, for comparison, the outline of a piston 101 according to FIG. 2, to illustrate the position of the box wall 14. FIG. 7 shows a lateral sectional view (pressure side 12) of the piston 1 according to FIG. 3 and, for comparison, the outline of a piston 101 according to FIG. 2, for illustrating the position of the box wall 14. The piston 1 has free spaces 21 behind the ring field 4. The box walls 14 are closer than in the case of previously customary lightweight pistons, as are known from DE 10 2005 041 002 A1.

"X1" denotes a spacing between the box walls on the counterpressure side according to DE 10 2005 041 002 A1. "X2" indicates the spacing between the box walls on the counterpressure side according to the exemplary embodiment from FIG. 3. "Y1" depicts the spacing between the box walls on the pressure side according to DE 10 2005 041 002 A1. "Y2" in turn illustrates the spacing between the box walls on the pressure side according to the exemplary embodiment from FIG. 3.

The following conditions are applicable:

$$X1>X2 \text{ and } Y1>Y2$$

Figure 8:
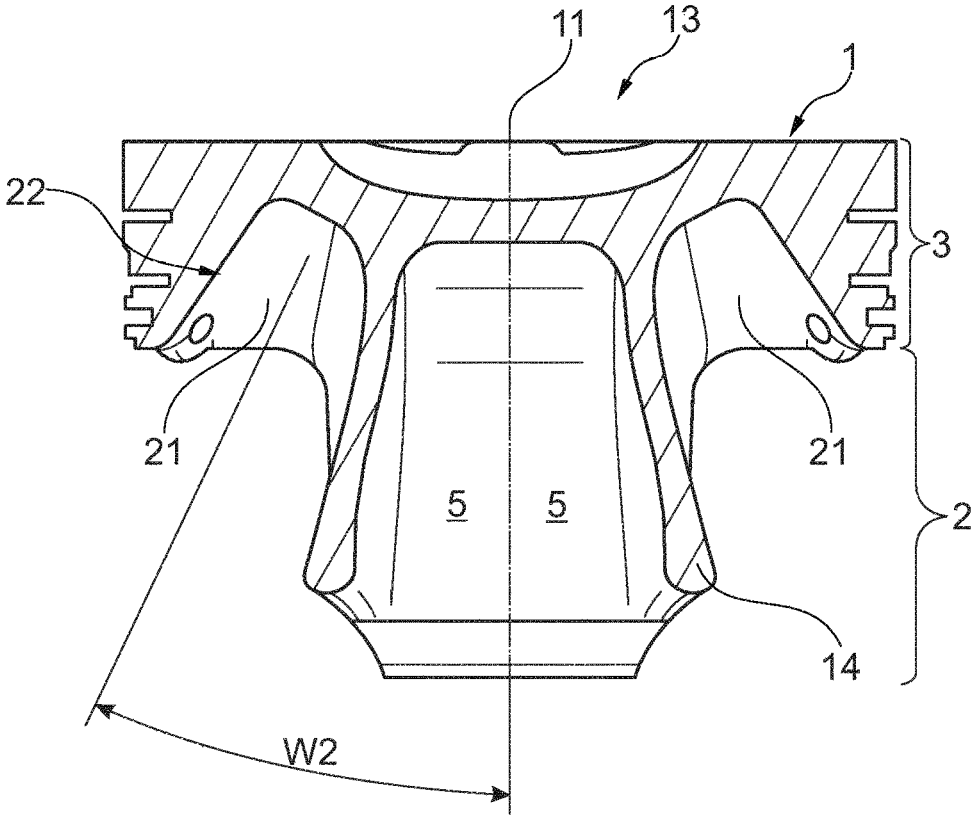
FIG. 8 shows a lateral sectional view (counterpressure side) of the piston according to FIG. 3.
Figure 9:
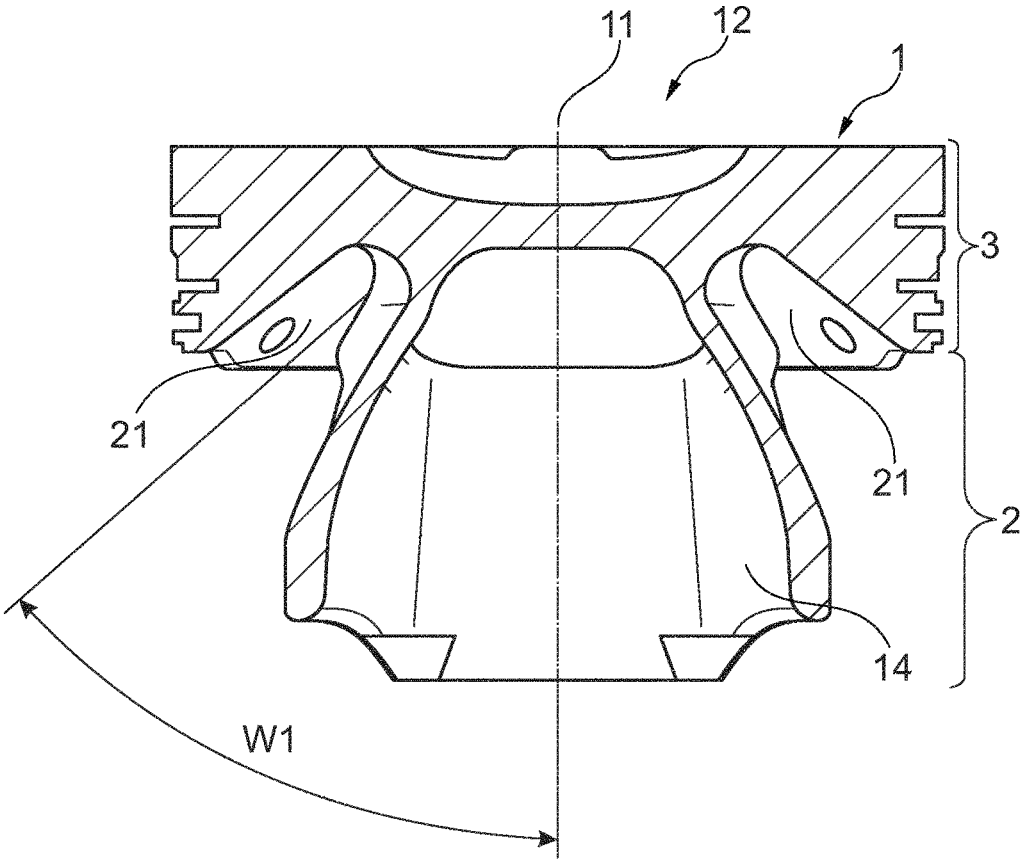
FIG. 9 shows a lateral sectional view (pressure side) of the piston according to FIG. 3.

FIG. 8 shows a lateral sectional view (counterpressure side 13 of the piston 1 according to FIG. 3, and FIG. 9 shows a lateral sectional view (pressure side 12) of the piston 1 according to FIG. 3; the position of the box wall 14 can be seen clearly. By means of the newly designed box walls 14, a reduction in an extraction slope 22 for the casting tool inserts is realized. This in turn permits an enlargement of the free spaces 21 in comparison to lightweight pistons as are known from DE 10 2005 041 002 A1, which leads to a further reduction in mass.

"W1" denotes the angle of the extraction slope 22 on the pressure side 12 of the piston 1. "W2" indicates the angle of the extraction slope 22 on the counterpressure side 13 of the piston 1.

The following condition is applicable:

$$W1>W2$$

Figure 10:
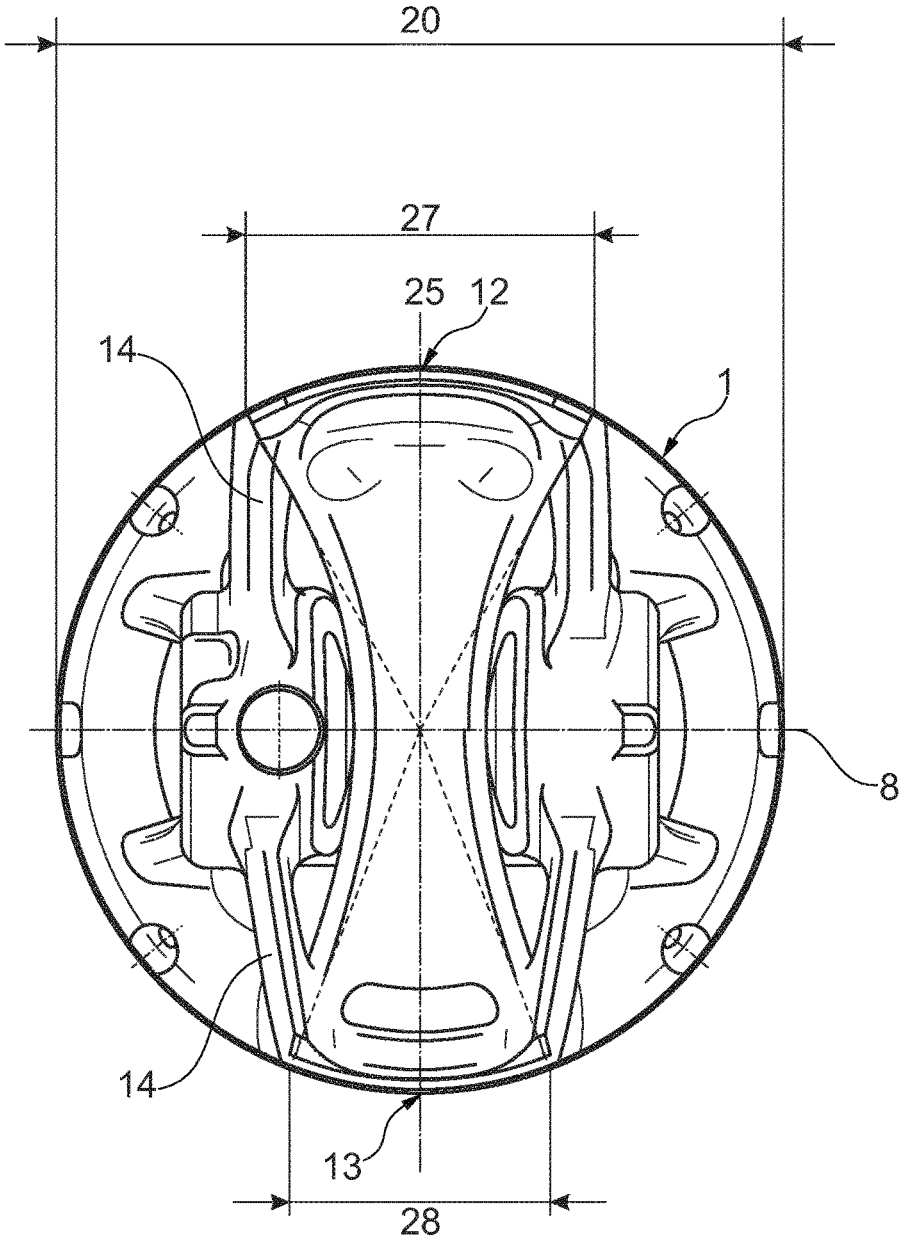
FIG. 10 shows a lower view of the piston according to FIG. 3.

FIG. 10 depicts a lower view of the piston 1 according to FIG. 3. The piston 1 has smaller skirt surfaces in the region of the skirt wall sections 5 on the pressure side 12 and on the counterpressure side 13 for reducing the friction. In the case of pistons for internal combustion engines with a crankshaft offset, the skirt surfaces have to be equalized in accordance with the resulting lateral forces. A box wall spacing 27 on the pressure side 12 and a box wall spacing 28 on the counterpressure side 13 are illustrated. Furthermore, the piston diameter 20 is marked.

The pressure side 12 has a spacing between the skirt surfaces or box wall spacing 27 of between 46% and 51% of the piston diameter 20. On the counterpressure side 13, there is a spacing between the skirt surfaces or a box wall spacing 28 of between 34% and 39% of the piston diameter 20.

Spacings between the skirt surfaces on the pressure side of between 52% and 57% and on the counterpressure side of between 40% and 45% of the piston diameter 20 are known from the prior art DE 10 2005 041 002 A1. A significant reduction in the skirt surfaces has therefore been achieved.

Figure 11:
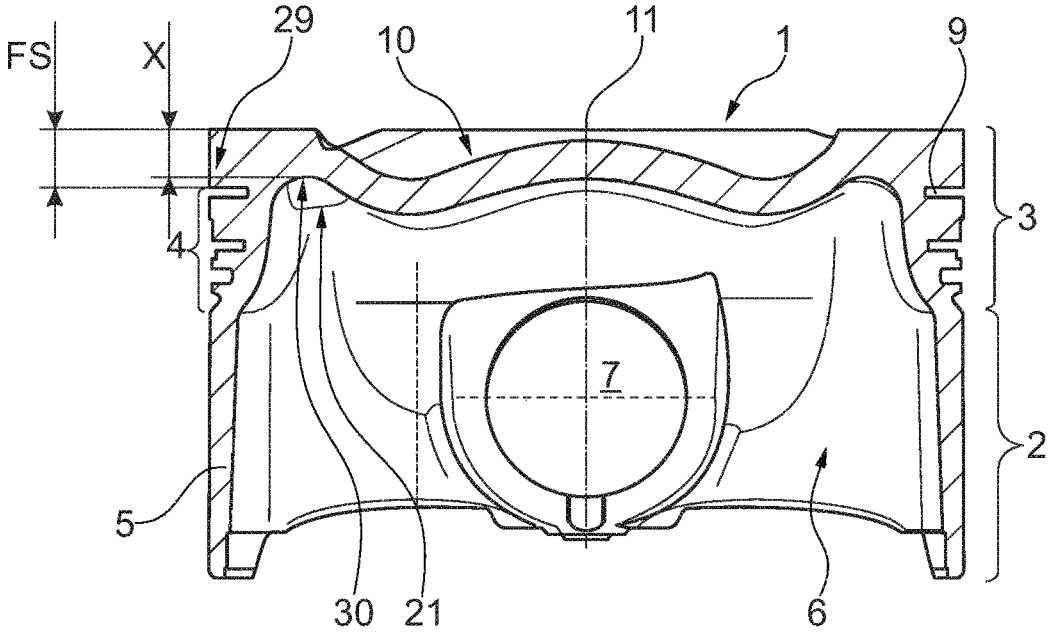
FIG. 11 shows a sectional view of the piston according to FIG. 3 transversely with respect to the bolt bore axis.
Figure 12:
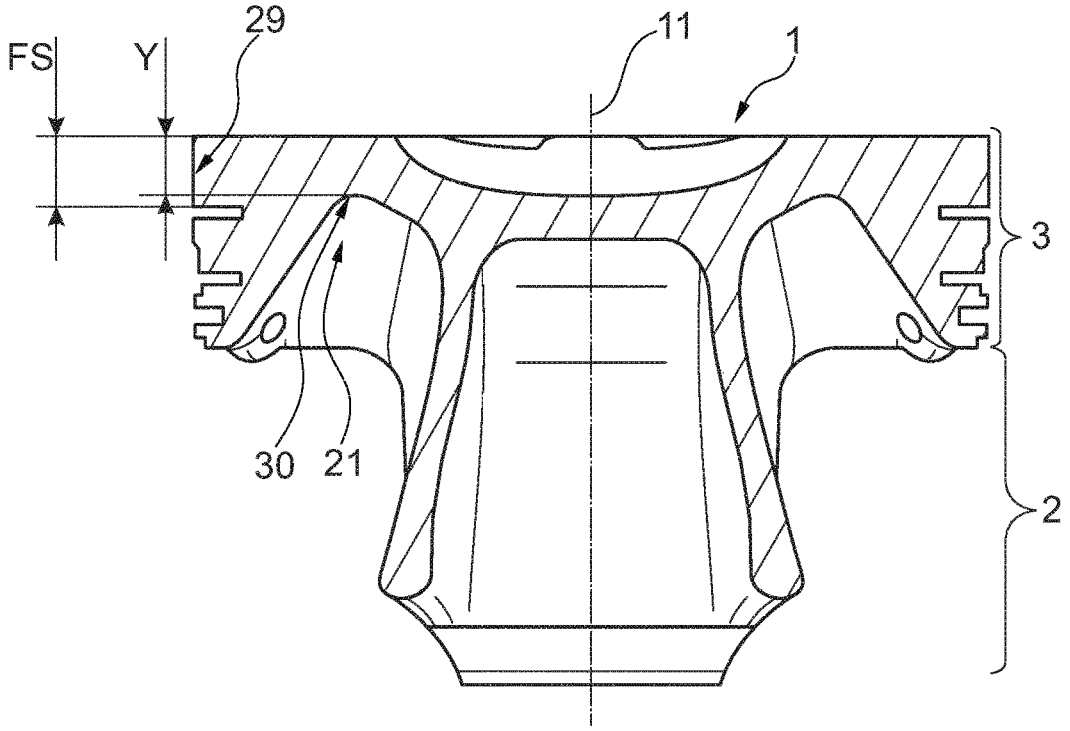
FIG. 12 shows a sectional view of the piston according to FIG. 3 outside the bolt bore axis.

FIG. 11 shows a sectional view of the piston 1 according to FIG. 3 transversely with respect to the bolt bore axis 8, and FIG. 12 shows a sectional view of the piston 1 according to FIG. 3 outside the bolt bore axis 8; the features for reducing the mass of the piston 1 are indicated here. A fire land 29 is illustrated which has a vertex 30 at its greatest extent in the direction of the piston head 3.

"X" describes the spacing between the upper edge of the fire land 29 and the vertex 30 of the free space 21 transversely with respect to the bolt bore axis 8. "Y" in turn depicts the spacing between the upper edge of the fire land 29 and the vertex 30 of the free space 21 parallel to the bolt bore axis 8. "FS" illustrates the dimension of the fire land 29. The dimension X and/or the dimension Y are/is smaller than the dimension FS, preferably between 65% and 90%.

The following conditions are applicable $$FS>X \text{ and } FS>Y$$

Figure 13:
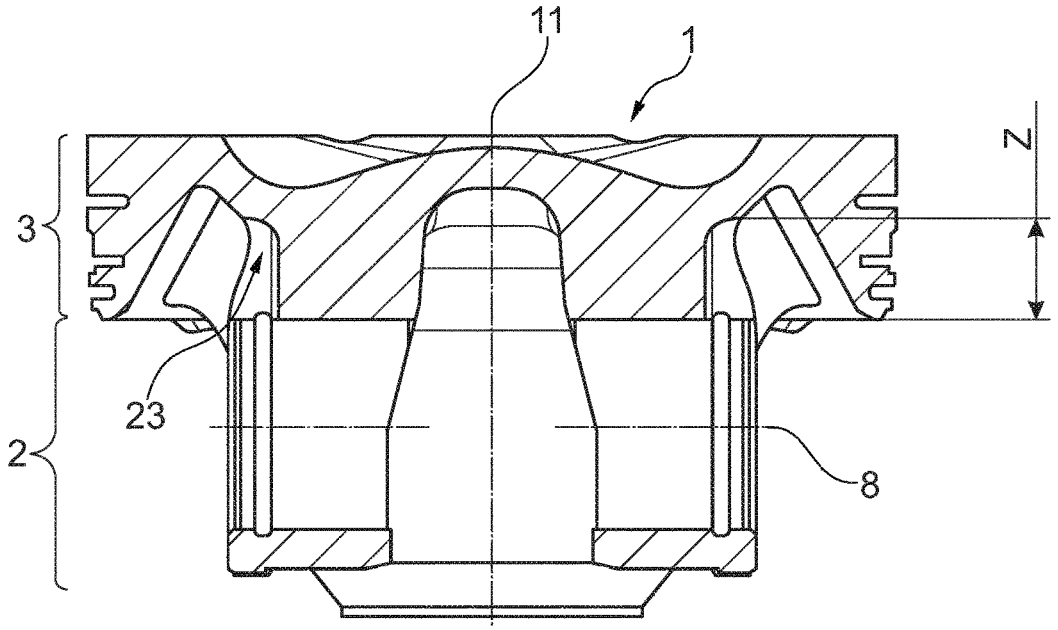
FIG. 13 shows a sectional view of a piston according to FIG. 3 along the bolt bore axis.

FIG. 13 shows a sectional view of a piston 1 according to FIG. 3 along the bolt bore axis 8; a further feature for reducing the mass can be seen. The radial depth of a lift-out groove 23 has the dimension Z with a value of greater than or equal to 4 mm

LIST OF REFERENCE SIGNS

1 Piston
2 Piston skirt
3 Piston head
4 Ring field
5 Skirt wall section
6 Connecting wall
7 Bolt bore
8 Bolt bore axis
9 Annular groove
10 Combustion space depression
11 Piston stroke axis
12 Pressure side
13 Counterpressure side
14 Box wall
15 Center line of the box wall on the pressure side
16 Center line of the box wall on the counterpressure side
17 Hub end surface
18 Lower apex
19 Upper apex
20 Piston diameter
21 Free space
22 Extraction slope
23 Lift-out groove
24 Curve of the box wall in the lower apex
25 Center line of the piston transversely with respect to the bolt bore axis
26 Curve of the box wall in the upper apex
27 Box wall spacing on the pressure side
28 Box wall spacing on the counterpressure side
29 Fire land
30 Vertex
101 Piston from the prior art
102 Piston skirt
103 Piston head
104 Ring field
105 Skirt wall section
106 Connecting wall
107 Bolt bore
109 Annular groove
110 Combustion space depression
111 Piston stroke axis
121 Free space
126 Drainage opening
R1 Radius of the box wall above the bolt bore of the piston
R2 Radius of the box wall on the pressure side of the piston
R3 Radius of the box wall on the counterpressure side of the piston
A Spacing between the center line of the box wall on the pressure side and center line of the piston transversely with respect to the piston bore axis
B Spacing between the center line of the box wall on the pressure side and center line of the piston transversely with respect to the bolt bore axis on the circumference of the piston
C Spacing between the center line of the box wall on the counterpressure side and center line of the piston transversely with respect to the bolt bore axis
D Spacing between the center line of the box wall on the counterpressure side and center line of the piston transversely with respect to the bolt bore axis on the circumference of the piston
X1 Spacing between the box walls on the counterpressure side according to DE 10 2005 041 002 A1
X2 Spacing between the box walls on the counterpressure side according to the exemplary embodiment
Y1 Spacing between the box walls on the pressure side according to DE 10 2005 041 002 A1
Y2 Spacing between the box walls on the pressure side according to the exemplary embodiment
W1 Angle of the extraction slope on the pressure side of the piston
W2 Angle of the extraction slope on the counterpressure side of the piston
X Spacing between the upper edge of the fire land and the vertex of the free space transversely with respect to the bolt bore axis
Y Spacing between the upper edge of the fire land and the vertex of the free space parallel to the bolt bore axis
Z Radial depth of the lift-out groove
FS Extent of the fire land

The invention claimed is:

1. A piston (1) for an internal combustion engine, comprising:

a piston skirt (2);

a piston head (3) which has a ring field (4) and is arranged on said piston skirt, wherein the piston skirt (2) has supporting skirt wall sections (5) and set-back box walls (14) which connect the skirt wall sections (5) to one another and have a curved profile and also a bolt bore (7), wherein, in the region of the bolt bore (7) below the ring field (4) an undercut free space (21) is present in the region of the piston head (3);

a pressure side (12);

a counterpressure side (13);

one of a spacing (27) between the box walls (14) of between 35% and 51% of a piston diameter (20) on the pressure side (12), or a spacing (28) between the box walls (14) of between 26% and 39% of the piston diameter (20) on the counterpressure side (13), wherein a spacing (X) between an upper edge of a fire land (29) and a vertex (30) of a free space (21)

transversely with respect to a bolt bore axis (8) of the piston (1) is smaller than a height dimension (FS) of the fire land (29).

2. The piston of claim 1 wherein the spacing (27) between the box walls (14) comprises between 40% and 51% of the piston diameter (20) on the pressure side (12).

3. The piston of claim 1 wherein the spacing (28) between the box walls (14) comprises between 30% and 39% of the piston diameter (20) on the counterpressure side (13).

4. The piston of claim 1 wherein the spacing (X) between the upper edge of the fire land (29) and the vertex (30) of the free space (21) transversely with respect to the bolt bore axis (8) of the piston (1) is between 50% and 95% of the value of the height dimension (FS) of the fire land (29).

5. The piston of claim 1 wherein a spacing (A) between a center line (15) of the box wall (14) on the pressure side (12) and a center line (25) of the piston (1) transversely with respect to the bolt bore axis (8) is greater than a distance (B) between a center line (15) of the box wall (14) on the pressure side (12) and the center line (25) of the piston (1) transversely with respect to the bolt bore axis (8) on the circumference of the piston (1).

6. The piston of claim 5 wherein the spacing (A) between the center line (15) of the box wall (14) on the pressure side (12) and the center line (25) of the piston (1) transversely with respect to the bolt bore axis (8) and the center line (15) of the box wall (14) is 10% to 35% of the piston diameter (20).

7. The piston (1) of claim 1 wherein the spacing (28) between the box walls (14) comprises between 34% and 37% of the piston diameter (20) on the counterpressure side (13).

8. The piston of claim 1 wherein the spacing (X) between the upper edge of the fire land (29) and the vertex (30) of the free space (21) transversely with respect to the bolt bore axis (8) of the piston (1) is between 65% and 90% of the value of the height dimension (FS) of the fire land (29).

9. An internal combustion engine piston comprising:

a head defining a piston diameter and having a pressure side and a counterpressure side;

a skirt having opposing skirt wall sections;

a first and a second set back box wall, each of the first and the second box walls having a curved shape, connecting the skirt wall sections and defining a bolt bore axis, the first and the second box walls define:

a spacing (A) between a centerline of the first and the second box wall on the pressure side and a piston centerline that is larger than a spacing (B) between a centerline of the first and the second box wall on the pressure side and the piston centerline at a circumference of the piston;

a spacing (C) between a centerline of the first and the second box wall on the counterpressure side and a piston centerline that is larger than a spacing (D) between a centerline of the first and the second box wall on the counterpressure side and the piston centerline at a circumference of the piston, wherein further the spacing (C) is less than the spacing (A);

a spacing (27) between the first and the second box wall on the pressure side is between 46% and 49% of the piston diameter;

a spacing (28) between the first and the second box wall on the counterpressure side is between 34% and 37% of the piston diameter; and a radial free space (21) positioned between the respective first and the second box wall and an opposing portion of a ring field, the free space defining a vertex (30); and a fire land connected to the piston head having an upper surface and a lower surface defining a height (FS), wherein a spacing (X) defined by the fire land upper surface and the vertex (30) is between 65% and 90% of the fire land height (FS).

10. A piston (1) for an internal combustion engine, comprising:

a piston skirt (2);

a piston head (3) which has a ring field (4) and is arranged on said piston skirt, wherein the piston skirt (2) has supporting skirt wall sections (5) and set-back box walls (14) which connect the skirt wall sections (5) to one another and have a curved profile and also a bolt bore (7), wherein, in the region of the bolt bore (7) below the ring field (4) an undercut free space (21) is present in the region of the piston head (3);

a pressure side (12);

a counterpressure side (13); and one of a spacing (27) between the box walls (14) of between 35% and 51% of a piston diameter (20) on the pressure side (12), or a spacing (28) between the box walls (14) of between 26% and 39% of the piston diameter (20) on the counterpressure side (13), wherein a spacing (Y) between an upper edge of a fire land (29) and a vertex (30) of a free space (21) parallel to a bolt bore axis (8) is smaller than a height dimension (FS) of the fire land (29).

11. The piston of claim 10 wherein the spacing (Y) between the upper edge of the fire land (29) and the vertex (30) of the free space (21) parallel to the bolt bore axis (8) is between 50% and 95% of the value of the height dimension (FS) of the fire land (29).

12. The piston of claim 10 wherein the spacing (Y) between the upper edge of the fire land (29) and the vertex (30) of the free space (21) parallel to the bolt bore axis (8) is between 65% and 90% of the value of the height dimension (FS) of the fire land (29).

13. A piston (1) for an internal combustion engine, comprising:

a piston skirt (2);

a piston head (3) which has a ring field (4) and is arranged on said piston skirt, wherein the piston skirt (2) has supporting skirt wall sections (5) and set-back box walls (14) which connect the skirt wall sections (5) to one another and have a curved profile and also a bolt bore (7), wherein, in the region of the bolt bore (7) below the ring field (4) an undercut free space (21) is present in the region of the piston head (3);

a pressure side (12);

a counterpressure side (13);

one of a spacing (27) between the box walls (14) of between 35% and 51% of a piston diameter (20) on the pressure side (12), or a spacing (28) between the box walls (14) of between 26% and 39% of the piston diameter (20) on the counterpressure side (13); and a radial depth (Z) of a lift-out groove (23) is of a size between 2 mm and less than 4 mm.

14. A piston (1) for an internal combustion engine, comprising:

a piston skirt (2);

a piston head (3) which has a ring field (4) and is arranged on said piston skirt, wherein the piston skirt (2) has supporting skirt wall sections (5) and set-back box walls (14) which connect the skirt wall sections (5) to one another and have a curved profile and also a bolt bore (7), wherein, in the region of the bolt bore (7) below the ring field (4) an undercut free space (21) is present in the region of the piston head (3);

a pressure side (12);

a counterpressure side (13);

one of a spacing (27) between the box walls (14) of between 35% and 51% of a piston diameter (20) on the pressure side (12), or a spacing (28) between the box walls (14) of between 26% and 39% of the piston diameter (20) on the counterpressure side (13);

a spacing (A) between a center line (15) of the box wall (14) on the pressure side (12) and a center line (25) of the piston (1) transversely with respect to the bolt bore axis (8) is greater than a distance (B) between a center line (15) of the box wall (14) on the pressure side (12) and the center line (25) of the piston (1) transversely with respect to the bolt bore axis (8) on the circumference of the piston (1); and a spacing (C) between a center line (16) of the box wall (14) on the counterpressure side and the center line (25) of the piston (1) transversely with respect to the bolt bore axis (8) is smaller than the spacing (A) between the center line (15) of the box wall (14) on the pressure side (12) and the center line (25) of the piston (1) transversely with respect to the bolt bore axis (8).

15. The piston of claim 14 wherein a spacing (D) between the center line (16) of the box wall (14) on the counterpressure side (13) and the center line (25) of the piston (1) transversely with respect to the bolt bore axis (8) on the circumference of the piston (1) is smaller than the spacing (C) between the center line (16) of the box wall (14) on the counterpressure side (13) and the center line (25) of the piston (1) transversely with respect to the bolt bore axis (8).

16. A piston (1) for an internal combustion engine, comprising:

a piston skirt (2);

a piston head (3) which has a ring field (4) and is arranged on said piston skirt, wherein the piston skirt (2) has supporting skirt wall sections (5) and set-back box walls which connect the skirt wall sections (5) to one another and have a curved profile and also a bolt bore (7), wherein, in the region of the bolt bore (7) below the ring field (4) an undercut free space (21) is present in the region of the piston head (3);

a pressure side (12);

a counterpressure side (13); and a spacing (27) between the box walls (14) of between 46% and 49% of a piston diameter (20) on the pressure side (12).

17. A piston (1) for an internal combustion engine, comprising:

a piston skirt (2);

a piston head (3) which has a ring field (4) and is arranged on said piston skirt, wherein the piston skirt (2) has supporting skirt wall sections (5) and set-back box walls (14) which connect the skirt wall sections (5) to one another and have a curved profile and also a bolt bore (7), wherein, in the region of the bolt bore (7) below the ring field (4) an undercut free space (21) is present in the region of the piston head (3);

a pressure side (12);

a counterpressure side (13);

one of a spacing (27) between the box walls (14) of between 35% and 51% of a piston diameter (20) on the pressure side (12), or a spacing (28) between the box walls (14) of between 26% and 39% of the piston diameter (20) on the counterpressure side (13); and a radial depth (Z) of a lift-out groove (23) is of a size of at least 4 mm.

* * * * *